United States Patent [19]

Thörnblom

[11] Patent Number: 4,808,795

[45] Date of Patent: Feb. 28, 1989

[54] METHOD OF CONTINUOUSLY OVERHEATING LARGE VOLUMES OF GAS

[75] Inventor: Jan Thörnblom, Borgvägen, Sweden

[73] Assignee: SKF Steel Engineering AB, Hofors, Sweden

[21] Appl. No.: 82,629

[22] Filed: Aug. 5, 1987

[30] Foreign Application Priority Data

Aug. 11, 1986 [SE] Sweden ..... 8603398

[51] Int. Cl.[4] ..... H05B 7/18

[52] U.S. Cl. ..... 219/383; 219/121.59; 219/121.54; 373/18; 373/25

[58] Field of Search ..... 219/121 PT, 121 PY, 219/121 PM, 121 PU, 121 PQ, 74, 75, 383, 384; 313/231.31, 231.41, 231.51; 315/111.21; 373/18–20, 22–24, 25

[56] References Cited

U.S. PATENT DOCUMENTS 3,777,112 12/1973 Fey ..... 219/121 P
4,013,867 3/1977 Fey ..... 219/383
4,056,704 11/1977 Beach et al. ..... 219/121 PY
4,361,441 11/1982 Tylko ..... 219/121 P
4,535,225 8/1985 Wolf et al. ..... 219/383
4,543,470 9/1985 Santen et al. ..... 219/383
4,596,019 6/1986 Schmidt et al. ..... 373/22

FOREIGN PATENT DOCUMENTS 371455 11/1974 Sweden .

*Primary Examiner*—M. H. Paschall
*Attorney, Agent, or Firm*—Armstrong, Nikaido, Marmelstein & Kubovcik

[57] ABSTRACT

A method of continuously overheating large volumes of gas wherein a gas flow is heated in a cylindrical pipe by means of an electric arc generated between two electrodes arranged in the pipe and axially spaced from each other, the gas being introduced in the tube at a speed of 15–100 m/s and supplied with a quantity of energy amounting to 0.1–0.5 kWh/m$^3$.

6 Claims, 1 Drawing Sheet

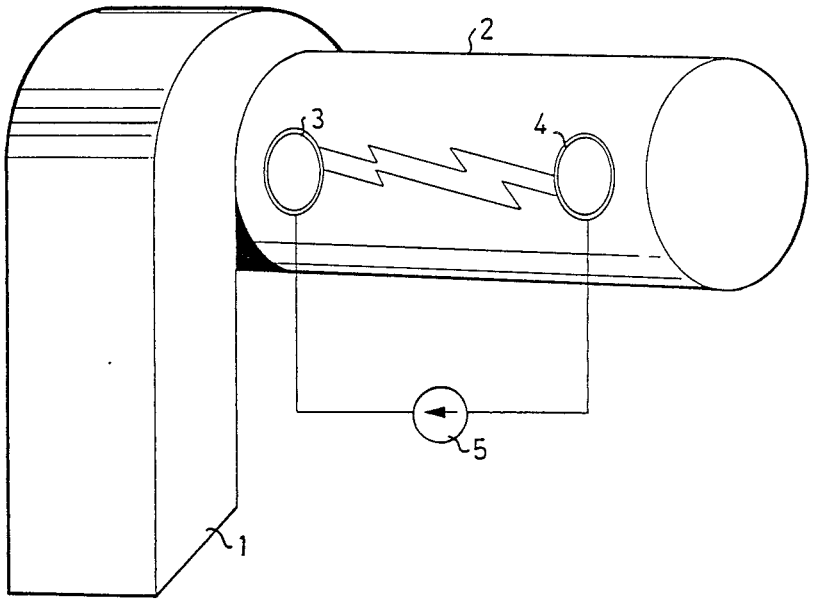
2
3
4
5
1

METHOD OF CONTINUOUSLY OVERHEATING LARGE VOLUMES OF GAS

The present invention relates to a method of continuously overheating large volumes of gas.

Many industrial processes require gases to be heated to elevated temperature without the chemical composition of the gas being altered. One example of such a process is the production of pig iron in a blast-furnace. Air heated to 1000°-1200° C. (blast) is used in this process. The air is heated by means of combustion and indirect heat-exchange via refractory brick. The maximum temperature which can be achieved using this method is about 1300° C. and is limited by material problems and the temperature of the exhaust gas from the combustion. This limit applies to substantially all indirect heating of gas via heat-exchanging.

In the blast furnace process, for instance, a further increase in the temperature of the air supplied would be extremely valuable. Increased blast temperature would enable more coal or oil to be used instead of the more expensive coke, thus reducing production costs.

One method of increasing the blast temperature is to use a plasma generator. In a plasma generator gas is heated by an electric arc to extremely high temperatures —3000° to 10,000° C.—see U.S. Pat. No. 4,596,019.

Mixing conventionally heated blast and plasma-heated air in suitable proportions enables high blast temperatures to be obtained. One of the drawbacks of this method is that since conventional plasma generators require that the gas to be heated be supplied at low temperature (below 100° C.), electric energy will be utilized to heat air in the temperature interval where heating by means of combustion would have been possible. Air produced in the process can often be utilized for the combustion and the heating costs via combustion are therefore lower than if electric power must be used. As much as possible of the energy supplied should therefore be obtained from combustion.

However, the method used hitherto for overheating blast with plasma generators entails an unnecessarily large amount of the energy being supplied in the form of electricity. The following calculation explains this.

EXAMPLE 1,000 $m^3$(n) blast is to be heated to 1500° C. Conventional equipment in the form of recuperators gives a temperature of 1100° C. Mixing in gas heated in a plasma generator is intended to result in a temperature of 1500° C. At 1100° C. the enthalpy in 1 $m^3$(n) air is 0.427 kWh/$m^3$(n) and at 1500° C. the enthalpy is 0.585 kWh/$m^3$(n). 158 kWh is thus required to raise the temperature in 1000 $m^3$(n) air from 1100° C. to 1500° C. With an efficiency rate of 85% for both recuperators and plasma generator, 186 kWh electricity must be supplied and 502 kWh by combustion. Since the air passing through the plasma generator is heated from 20° C., the following is instead obtained:

| | amount $m^3$ (n) | temp. °C. | enthalpy kWh/$m^3$ (n) | effic. % | energy req. kWh |
|---|---|---|---|---|---|
| from recuperators | 923 | 1100 | 0.427 | 85 | 464 |
| plasma gas | 77 | — | 2.5 | 85 | 226 |
| | 1000 | 1500 | 0.585 | 85 | 690 |

From the above, it can be seen that 38 kWh gas heating must be replaced by electrical heating and the consumption of electricity is 22% greater than would have been required had electricity alone been used to increase the gas temperature from 1100° C. to 1500° C.

According to the present invention it has now proved possible to overheat hot gas by means of plasma heating without the drawback described above. This is achieved according to the invention using the method described in the introduction, substantially by heating a gas flow in a cylindrical pipe with the aid of an electric arc generated between two electrodes arranged in the pipe and axially spaced from each other, the gas being introduced in the pipe at a speed of 15-100 m/s and supplied with a quantity of energy amounting to 0.1-0.5 kWh/$m^3$. Surprisingly, a stable electric arc is hereby obtained, even in a pipe with extremely large diameter, if the gas to be heated is caused to rotate in the pipe with the arc.

Additional characteristics of the invention are revealed in the features defined in the following claims.

The invention will be described more fully in the following with reference to the accompanying drawing.

The means shown in the drawing comprises a pipe 1 through which the gas to be heated is flowing. It is connected tangentially via one or more pipes to a pipe 2 in which two or more water-cooled electrodes 3, 4, e.g. in the form of rings, are applied. The electrodes 3, 4 are connected to a current source 5 and an arc is caused to burn between the electrodes 3, 4. Ignition of the arc is effected, for instance, by using a thin metal wire to short-circuit the electrodes. The diameter of the wire is chosen so that it will melt when the current exceeds 1500 A. It has been found that the current should exceed 1000 A in order to produce a stable arc. The distance between the electrodes should be such that a suitable voltage drop is obtained. The voltage drop has been found to be 15-40 V/cm depending on the current strength and gas flow. Examples of suitable electrode distances are between 0.5-2 m. Distances shorter than 0.5 m are of course possible, but are often of no interest since a relatively low arc voltage will then be obtained. If, on the other hand, the electrode distance is greater than about 2 m, the current strength, the characteristic of the current source and the gas flow must be carefully adjusted to ensure a stable arc. The composition of the gas to be heated also affects the stability of the arc. An arc is considerably less stable in hydrogen, for instance, than in air.

The pipes 1 and 2 are dimensioned to give a gas flow in the longitudinal direction of the pipes of about 15-40 m/sek, preferably 20-30 m/sek.

I claim:

1. A method of continuously heating large volumes of a gas having an initial temperature of 800°-1300° C. which comprises passing the gas at a flow rate of 15-100 m/s through a cylindrical pipe, said cylindrical pipe having two electrodes located on its axis and spaced apart from each other, and heating the gas passing through the cylindrical pipe by imparting to the gas 0.1-0.5 kWh/$m^3$ of energy from an electric arc generated between the two electrodes.

2. A method as claimed in claim 1, wherein the gas has an initial temperature of 800°-1100° C.

3. A method as claimed in claim 1, wherein the flow rate of the gas is 20-60 m/s.

4. A method as claimed in claim 1, wherein the flow rate of the gas is 10-50 $m^3$/s.

5. A method as claimed in claim 1, wherein the gas is heated to 1500° C.

6. A method as claimed in claim 1, wherein the gas is introduced tangentially into the pipe.

* * * * *